US011809121B2

(12) United States Patent
Omoto

(10) Patent No.: US 11,809,121 B2
(45) Date of Patent: Nov. 7, 2023

(54) IMAGE FORMING APPARATUS THAT URGES CLEANING BLADE REPLACEMENT BASED ON CALCULATED ACTUAL LINEAR PRESSURE

(71) Applicant: KYOCERA Document Solutions Inc., Osaka (JP)

(72) Inventor: Koki Omoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/970,408

(22) Filed: Oct. 20, 2022

(65) Prior Publication Data

US 2023/0129861 A1 Apr. 27, 2023

(30) Foreign Application Priority Data

Oct. 26, 2021 (JP) ..... 2021-174673

(51) Int. Cl.
*G03G 21/00* (2006.01)
*G03G 21/20* (2006.01)

(52) U.S. Cl.
CPC ..... *G03G 21/0011* (2013.01); *G03G 21/20* (2013.01)

(58) Field of Classification Search
CPC ..... G03G 21/0011; G03G 21/20
See application file for complete search history.

(56) References Cited

U.S. PATENT DOCUMENTS

2017/0052494 A1 2/2017 Yoshida

FOREIGN PATENT DOCUMENTS

JP 2017-40707 A 2/2017
WO WO-2019164071 A1 * 8/2019 ..... G03G 21/0017

* cited by examiner

*Primary Examiner* — Walter L Lindsay, Jr.
*Assistant Examiner* — Milton Gonzalez
(74) *Attorney, Agent, or Firm* — Stein IP, LLC

(57) ABSTRACT

A control unit of an image forming apparatus calculates an actual linear pressure of a cleaning blade by taking into account, with respect to an initial linear pressure of the cleaning blade measured in advance, a linear pressure reduction based on cumulative rotation time of an image carrier, a linear pressure reduction based on cumulative non-rotation time of the image carrier, and a linear pressure reduction based on an external temperature detected by a temperature detection unit, and the control unit outputs information for urging replacement of the cleaning blade to an output unit when a linear pressure difference between the actual linear pressure of the cleaning blade and a lower-limit linear pressure of the cleaning blade calculated in advance from an abrasion amount of the cleaning blade with respect to the cumulative number of rotations of the image carrier reaches a predetermined threshold value.

4 Claims, 4 Drawing Sheets

IMAGE FORMING APPARATUS THAT URGES CLEANING BLADE REPLACEMENT BASED ON CALCULATED ACTUAL LINEAR PRESSURE

INCORPORATION BY REFERENCE

This application is based on and claims the benefit of priority from Japanese Patent Application No. 2021-174673 filed on Oct. 26, 2021, the contents of which are hereby incorporated by reference.

BACKGROUND

The present disclosure relates to an image forming apparatus.

In image forming apparatuses employing an electrophotographic method, such as copiers, printers, etc., after a toner image is transferred from an image carrier such as a photoconductive drum to a sheet (a recording medium), an intermediate transfer belt, or the like, a minute amount of residues such as toner, paper powder, and the like may remain adhered to the surface of the photoconductive drum. Such residues remaining on the surface of the photoconductive drum can be an obstacle to next formation of a new image, and thus cleaning is necessary. Widely known as a method for cleaning the surface of the photoconductive drum is a method in which residues are scraped off from the surface of the photoconductive drum by a cleaning blade in linear contact with the surface of the photoconductive drum.

SUMMARY

According to one aspect of the present disclosure, an image forming apparatus includes an image carrier, a cleaning unit, a temperature detection unit, an output unit, and a control unit. The image carrier has a surface on which a toner image is formed. The cleaning unit includes a cleaning blade in linear contact with the surface of the image carrier, and removes a residue remaining on the surface of the image carrier. The temperature detection unit detects an external temperature. The output unit outputs information regarding image formation. The control unit controls operation of the image carrier and the output unit. Here, the control unit calculates an actual linear pressure of the cleaning blade by taking into account, with respect to an initial linear pressure of the cleaning blade measured in advance, a linear pressure reduction based on cumulative rotation time of the image carrier, a linear pressure reduction based on cumulative non-rotation time of the image carrier, and a linear pressure reduction based on the external temperature detected by the temperature detection unit, and the control unit outputs information for urging replacement of the cleaning blade to the output unit when a linear pressure difference between the actual linear pressure of the cleaning blade and a lower-limit linear pressure of the cleaning blade calculated in advance from an abrasion amount of the cleaning blade with respect to the cumulative number of rotations of the image carrier reaches a predetermined threshold value.

DETAILED DESCRIPTION

An embodiment of the present disclosure will be described below with reference to the drawings. The present disclosure, however, is not limited to what is specifically described below.

Figure 1:
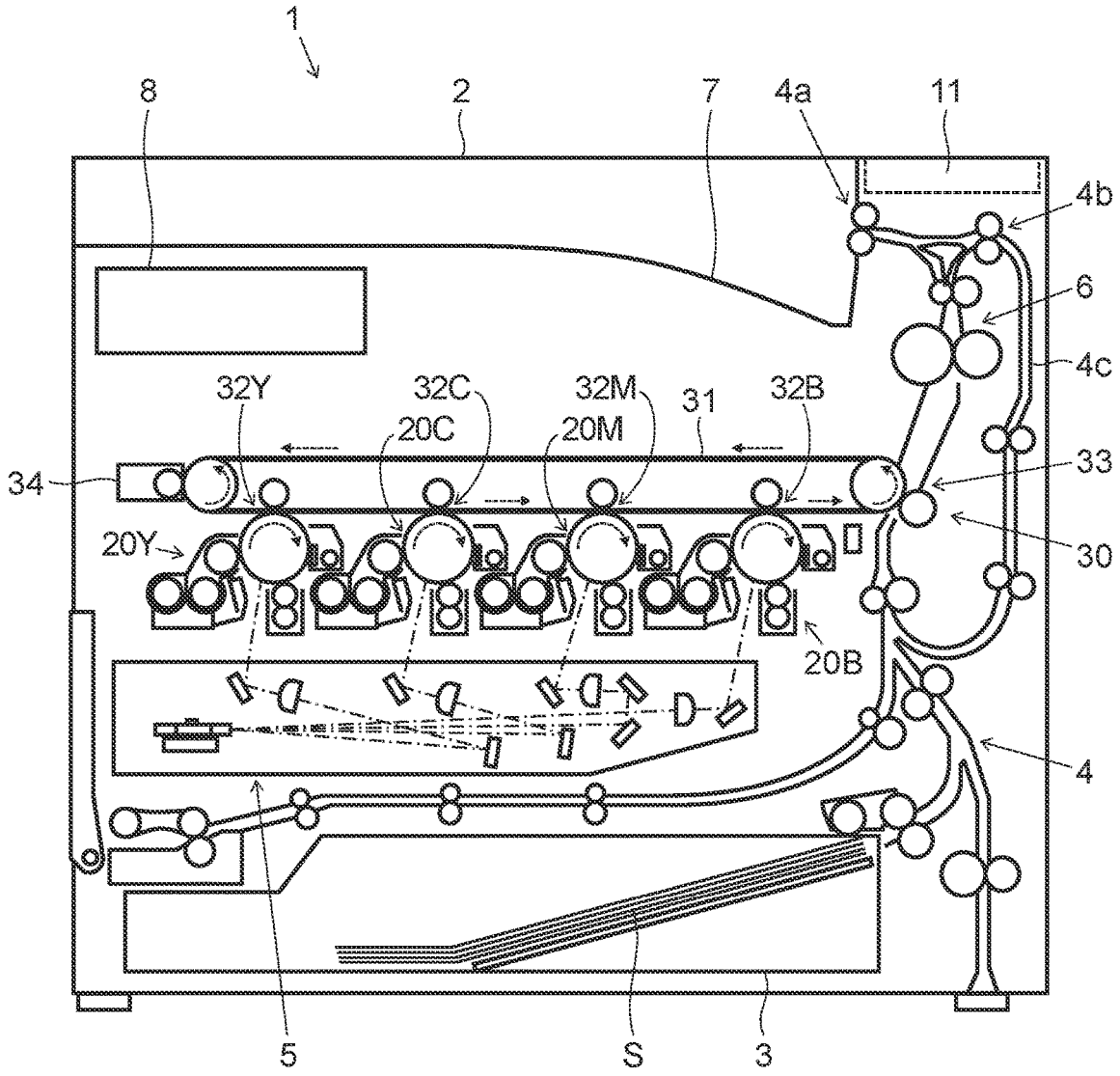
FIG. 1 is a schematic sectional front view of an image forming apparatus according to an embodiment of the present disclosure.
Figure 2:
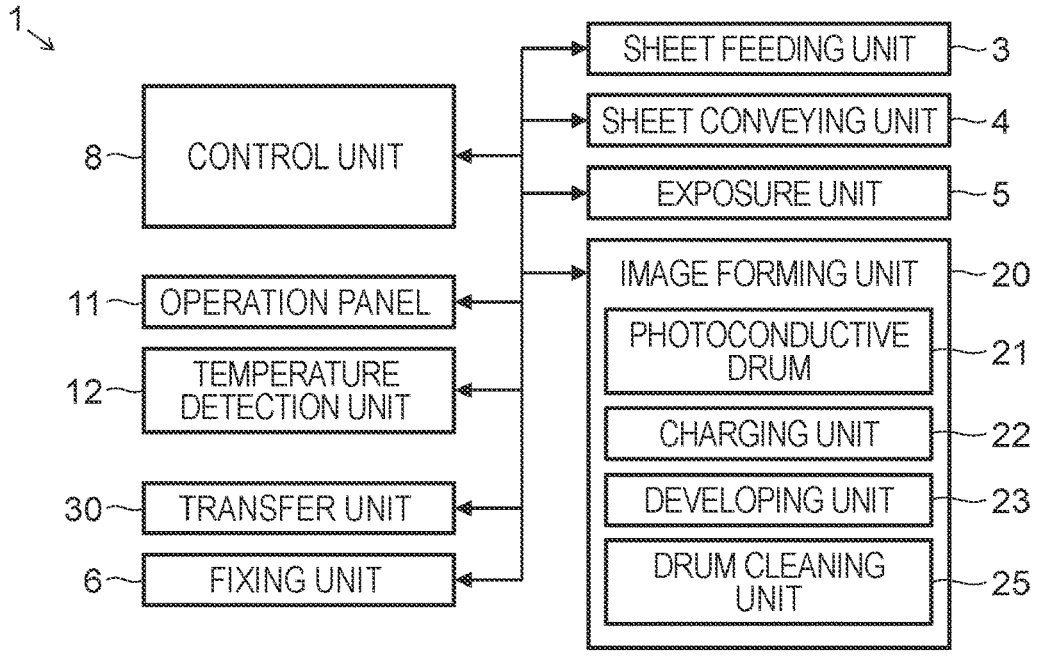
FIG. 2 is a block diagram showing a configuration of the image forming apparatus shown in FIG. 1.
Figure 3:
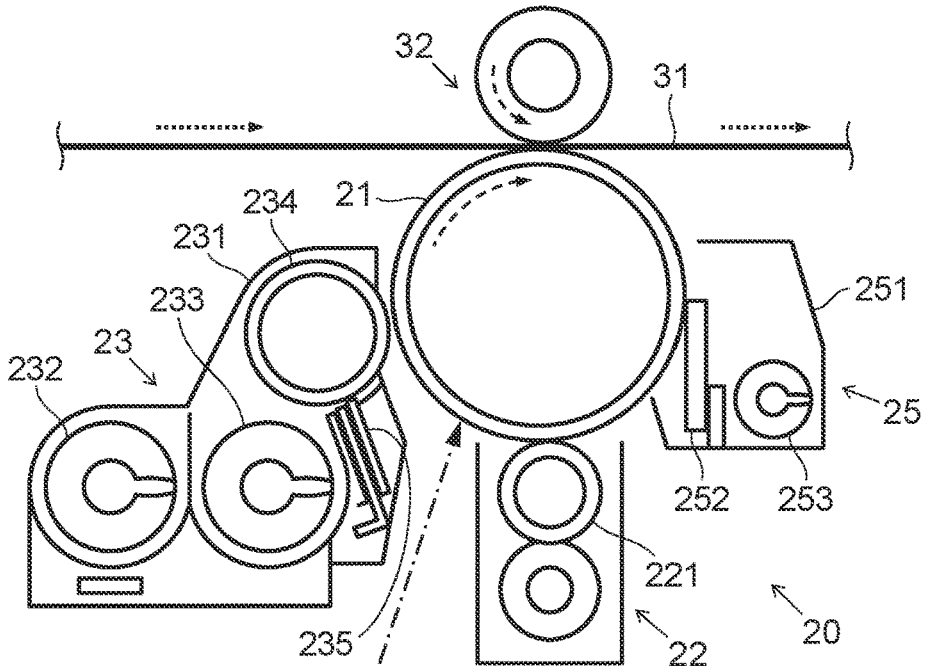
FIG. 3 is a schematic sectional front view of an area around an image forming unit of the image forming apparatus shown in FIG. 1.

FIG. 1 is a schematic sectional front view of an image forming apparatus 1 according to an embodiment. FIG. 2 is a block diagram showing a configuration of the image forming apparatus 1 shown in FIG. 1. FIG. 3 is a schematic sectional front view of an area around an image forming unit 20 of the image forming apparatus 1 shown in FIG. 1. One example of the image forming apparatus 1 according to this embodiment is a color printer of a tandem-type which transfers a toner image onto a sheet (a recording medium) S by using an intermediate transfer belt 31. The image forming apparatus 1 may instead be, for example, what is called a multifunction peripheral which is provided with functions of printing, scanning (image reading), facsimile transmission, etc.

As shown in FIGS. 1, 2, and 3, the image forming apparatus 1 includes, in a main body 2 thereof, a sheet feeding unit 3, a sheet conveying unit 4, an exposure unit 5, an image forming unit 20, a transfer unit 30, a fixing unit 6, a sheet discharge unit 7, and a control unit 8.

The sheet feeding unit 3 is disposed at a bottom portion of the main body 2. The sheet feeding unit 3 stores therein a plurality of sheets S and, during printing, feeds them out separately one by one. The sheet conveying unit 4 conveys a sheet S fed out from the sheet feeding unit 3 to a secondary transfer unit 33 and then to the fixing unit 6, and further, discharges the sheet S having undergone fixing via a sheet discharge port 4*a* into the sheet discharge unit 7. For two-sided printing, the sheet conveying unit 4 sorts, by means of a branch portion 4*b*, the sheet S having an image fixed on its first side into an inverting conveying portion 4*c*, and conveys the sheet S back to the secondary transfer unit 33 and to the fixing unit 6. The exposure unit 5 irradiates the image forming unit 20 with laser light that is controlled based on image data.

The image forming unit 20 is disposed below the intermediate transfer belt 31. The image forming unit 20 includes an image forming unit 20Y for yellow, an image forming unit 20C for cyan, an image forming unit 20M for magenta, and an image forming unit 20B for black. The four image forming units 20 are similar to each other in basic configuration. Thus, hereinafter, the color signs "Y", "C", "M", and "B" provided for distinction among the different colors may sometimes be omitted unless specific distinction is necessary.

The image forming unit 20 includes a photoconductive drum (an image carrier) 21 supported to be rotatable in a predetermined direction (a clockwise direction in FIGS. 1 and 3). The image forming unit 20 further includes a charging unit 22, a developing unit 23, and a drum cleaning unit (a cleaning unit) 25 disposed around the photoconductive drum 21 along a rotation direction thereof. Between the developing unit 23 and the drum cleaning unit 25, a primary transfer unit 32 is disposed.

The photoconductive drum 21 has a photoconductive layer on a surface thereof. The charging unit 22 charges the surface of the photoconductive drum 21 to a predetermined potential. The exposure unit 5 exposes, to light, the surface of the photoconductive drum 21 charged by the charging unit 22, and thereby forms an electrostatic latent image of an original image on the surface of the photoconductive drum 21. The developing unit 23 causes toner to adhere to the electrostatic latent image to thereby develop it, and thereby forms a toner image. The four image forming units 20 respectively form toner images of different colors. The drum cleaning unit 25 performs cleaning by removing residues such as toner and the like remaining on the surface of the photoconductive drum 21. In this manner, the image forming units 20 each form an image (a toner image) to be later transferred to a sheet S.

The transfer unit 30 includes the intermediate transfer belt 31, primary transfer units 32Y, 32C, 32M, and 32B, a secondary transfer unit 33, and a belt cleaning unit 34. The intermediate transfer belt 31 is disposed above the four image forming units 20. The intermediate transfer belt 31 is supported to be rotatable in a predetermined direction (a counterclockwise direction in FIG. 1). The intermediate transfer belt 31 is an intermediate transfer member, onto which toner images formed on the surfaces of the photoconductive drums 21 in the four image forming units 20 are primarily transferred so as to be sequentially superposed one on top of another. The four image forming units 20 are aligned from an upstream side toward a downstream side of the intermediate transfer belt 31 in a rotation direction thereof in what is called a tandem-type arrangement.

The primary transfer units 32Y, 32C, 32M, and 32B are respectively disposed above the image forming units 20Y, 20C. 20M, and 20B of the different colors, with the intermediate transfer belt 31 therebetween. The secondary transfer unit 33 is disposed at a position that is, in the sheet conveying unit 4, on an upstream side of the fixing unit 6 in a sheet conveyance direction and that is, in the transfer unit 30, on a downstream side of the image forming units 20Y, 20C, 20M, and 20B of the different colors in the rotation direction of the intermediate transfer belt 31. The belt cleaning unit 34 is disposed on an upstream side of the image forming units 20Y, 20C, 20M, and 20B of the different colors in the rotation direction of the intermediate transfer belt 31.

The primary transfer unit 32 transfers the toner images formed on the surfaces of the photoconductive drums 21 to the intermediate transfer belt 31. In other words, at the primary transfer units 32Y, 32C, 32M, and 32B of the different colors, the toner images are primarily transferred to the surface of the intermediate transfer belt 31. Along with rotation of the intermediate transfer belt 31, at predetermined timing, the toner images formed at the four image forming units 20 are sequentially transferred to the intermediate transfer belt 31 to be superposed one on top of another, and thereby, on the surface of the intermediate transfer belt 31, a color toner image is formed in which toner images of the four colors, namely, yellow, cyan, magenta, and black, are superposed one on top of another.

At a secondary transfer nip portion formed at the secondary transfer unit 33, the color toner image formed on the surface of the intermediate transfer belt 31 is transferred onto a sheet S having been synchronously conveyed to the secondary transfer nip portion by the sheet conveying unit 4. The belt cleaning unit 34 performs cleaning by removing residual toner and the like remaining on the intermediate transfer belt 31 after the secondary transfer. In this manner, the transfer unit 30 transfers the toner images formed on the photoconductive drums 21 to the sheet S.

The fixing unit 6 is disposed above the secondary transfer unit 33. The fixing unit 6 applies heat and pressure to the sheet S to which the toner image has been transferred, and thereby fixes the toner image on the sheet S.

The sheet discharge unit 7 is disposed above the transfer unit 30. The printed sheet S having the toner images fixed thereon is conveyed to the sheet discharge unit 7. From the sheet discharge unit 7, a printed sheet (printed matter) can be taken out from above.

The control unit 8 includes a CPU, an image processor, a storage, and other electronic circuits and parts (of which none is illustrated). The CPU controls operations of various components provided in the image forming apparatus 1 on the basis of a control program and control data stored in the storage, and thereby performs processing related to functions of the image forming apparatus 1. The sheet feeding unit 3, the sheet conveying unit 4, the exposure unit 5, the image forming unit 20, the transfer unit 30, and the fixing unit 6 each individually receive a command from the control unit 8, and cooperate with each other to perform printing with respect to a sheet S. The storage is configured, for example, as a combination of nonvolatile storage devices such as a program ROM (read only memory), a data ROM, etc., and a volatile storage device such as a RAM (random access memory).

The image forming apparatus 1 further includes an operation panel (output unit) 11 and a temperature detection unit 12.

The operation panel 11 is disposed at an upper portion of the main body 2. The operation panel 11 accepts user's inputs of settings of, for example, the type and the size of a sheet S to be used for printing, etc. Furthermore, the operation panel 11 provides the user with information related to image formation, such as a state of the image forming apparatus 1, notes, an error message, etc., by outputting (displaying) such information. Note that the image forming apparatus 1 can also output the information related to image formation to an external communication device or computer via a communication unit (unillustrated) connected to a network.

The temperature detection unit 12 is disposed near a casing of the main body 2. The temperature detection unit 12 includes a sensor such as a thermistor, for example, and detects a temperature of an outside (an installation environment) of the image forming apparatus 1. The control unit 8 receives an output signal from the temperature detection unit 12, and recognizes the temperature of the outside of the image forming apparatus 1.

Next, a configuration of the image forming units 20 will be described with reference to FIG. 3. Here, since the four image forming units 20 are similar to each other in basic configuration, as to their components, the color distinction signs and descriptions may be omitted unless specific distinction is necessary.

The image forming units 20 each include the photoconductive drum 21, the charging unit 22, the developing unit 23, and the drum cleaning unit 25.

The photoconductive drum 21 has a cylindrical shape and is rotatably supported with a center axis thereof horizontal, and the photoconductive drum 21 is driven by a drive unit (unillustrated) to rotate at a constant speed about the center axis. The photoconductive drum 21 has a photoconductive layer constituted by an inorganic photoconductive body such as an amorphous silicon on a surface of a drum base tube made of a metal such as aluminum. On the surface of the photoconductive drum 21, an electrostatic latent image is formed.

The charging unit 22 includes, for example, a charging roller 221. The charging roller 221 extends parallel to an axis direction of the photoconductive drum 21, and is rotatably supported with a center axis thereof horizontal. The charging roller 221 is in contact with the surface of the photoconductive drum 21, and thereby rotates following the rotation of the photoconductive drum 21. The charging roller 221 has an electrically conductive layer formed on a surface of a metal core made of a cross-linked rubber containing an ionic conductive material, for example. When a predetermined charging voltage is applied to the charging roller 221, the surface of the photoconductive drum 21 is uniformly charged.

The developing unit 23 is disposed on a downstream side of the charging unit 22 in a rotation direction of the photoconductive drum 21. The developing unit 23 includes a development container 231, a first conveying member 232, a second conveying member 233, a developing roller 234, and a regulation member 235.

The development container 231 has an elongated shape extending along the axis direction of the photoconductive drum 21 (a depth direction of the sheet on which FIG. 3 is drawn), and is disposed with a longitudinal direction thereof horizontal. The development container 231 contains a two-component developer including a toner and a magnetic carrier. The developer may be a one-component developer instead.

The first and second conveying members 232 and 233 are supported in the development container 231 to be rotatable about their respective axes extending parallel to the photoconductive drum 21. The first and second conveying members 232 and 233 rotate about their respective axes, and thereby convey the developer in respective directions opposite to each other along the direction of their axes of rotation, while stirring the developer.

The developing roller 234 is supported in the development container 231 to be rotatable about an axis extending parallel to the axis of the photoconductive drum 21. The developing roller 234 has part of a surface thereof exposed from the development container 231 to face, and to be close to, the photoconductive drum 21. The developing roller 234 carries toner on the surface thereof, and the toner is supplied to the surface of the photoconductive drum 21 at aa facing region with respect to the photoconductive drum 21 at which the developing roller 234 faces the photoconductive drum 21. The developing roller 234 causes the toner in the development container 231 to adhere to the electrostatic latent image formed on the surface of the photoconductive drum 21, to thereby form a toner image.

The regulation member 235 is disposed on an upstream side of the facing region of the developing roller 234 and the photoconductive drum 21 in the rotation direction of the developing roller 234. The regulation member 235 is disposed close to, and facing, the developing roller 234 with a predetermined gap between a leading edge of the regulation member 235 and the surface of the developing roller 234. The regulation member 235 extends over an entire area in an axis direction of the developing roller 234 (the depth direction of the sheet of FIG. 3).

The toner in the development container 231 is charged while being stirred and circulated by the first and second conveying members 232 and 233, to be carried on the surface of the developing roller 234. The developer (the toner) carried on the surface of the developing roller 234 has a layer thickness thereof regulated by the regulation member 235. When a predetermined developing voltage is applied to the developing roller 234, a potential difference is generated with respect to the surface of the photoconductive drum 21, and this causes the toner carried on the surface of the developing roller 234 to soar in a developing space to the surface of the photoconductive drum 21, and thereby the electrostatic latent image on the surface of the photoconductive drum 21 is developed.

The drum cleaning unit 25 is disposed on a downstream side of the primary transfer unit 32 in the rotation direction of the photoconductive drum 21. The drum cleaning unit 25 includes a collecting container 251, a cleaning blade 252, and a collecting spiral 253.

The collecting container 251 has an elongated shape extending along the axis direction of the photoconductive drum 21 (the depth direction of the sheet on which FIG. 3 is drawn), and is disposed with a longitudinal direction thereof horizontal. The collecting container 251 receives and stores therein residues such as toner and the like removed by the cleaning blade 252 from the surface of the photoconductive drum 21.

The cleaning blade 252 has a plate-like shape extending along the axis direction of the photoconductive drum 21, and is formed of an elastic member such as a polyurethane rubber, for example. The cleaning blade 252 is disposed on a downstream side of a contact edge of the cleaning blade 252 and the photoconductive drum 21 such that the cleaning blade 252, at the contact edge, forms a predetermined angle with respect to a tangential direction of the photoconductive drum 21. The cleaning blade 252 is in linear contact with the surface of the photoconductive drum 21 with a predetermined pressure. The cleaning blade 252, after the primary transfer, removes residues including toner remaining on the surface of the photoconductive drum 21.

The collecting spiral 253 is disposed in a region that is in a lower portion inside the collecting container 251 and that is separated from the photoconductive drum 21 via the cleaning blade 252. The collecting spiral 253 is supported in the collecting container 251 so as to be rotatable about an axis extending parallel to the rotation axis of the photoconductive drum 21. The collecting spiral 253 includes a spiral-shaped conveying blade extending in an axis direction thereof, for example. The collecting spiral 253 conveys residues, such as toner, removed from the surface of the photoconductive drum 21 into a collected waste container (unillustrated) disposed outside the drum cleaning unit 25.

Figure 4:
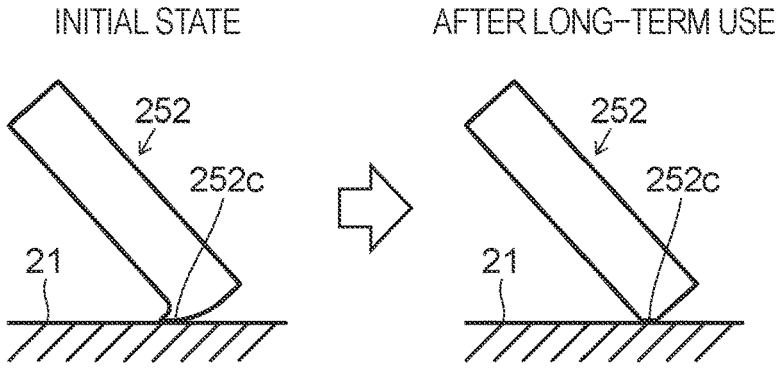
FIG. 4 is an explanatory diagram showing a change in shape of a cleaning blade of a drum cleaning unit.

FIG. 4 is an explanatory diagram showing a change in shape of the cleaning blade 252 of the drum cleaning unit 25. The cleaning blade 252 is in linear contact with the surface of the photoconductive drum 21 with the predetermined pressure, and thereby, as shown in FIG. 4, in its initial state, the cleaning blade 252 is elastically deformed such that a contact edge 252*c* thereof in linear contact with the surface of the photoconductive drum 21 is distorted. Thereby, residues including toner can be appropriately removed from the surface of the photoconductive drum 21. However, as shown in FIG. 4, after a long-term use of the cleaning blade 252, a portion thereof around the contact edge 252*c* is worn out, which causes reduction in linear pressure. This may unfortunately cause poor cleaning with respect to the surface of the photoconductive drum 21.

Figure 5:
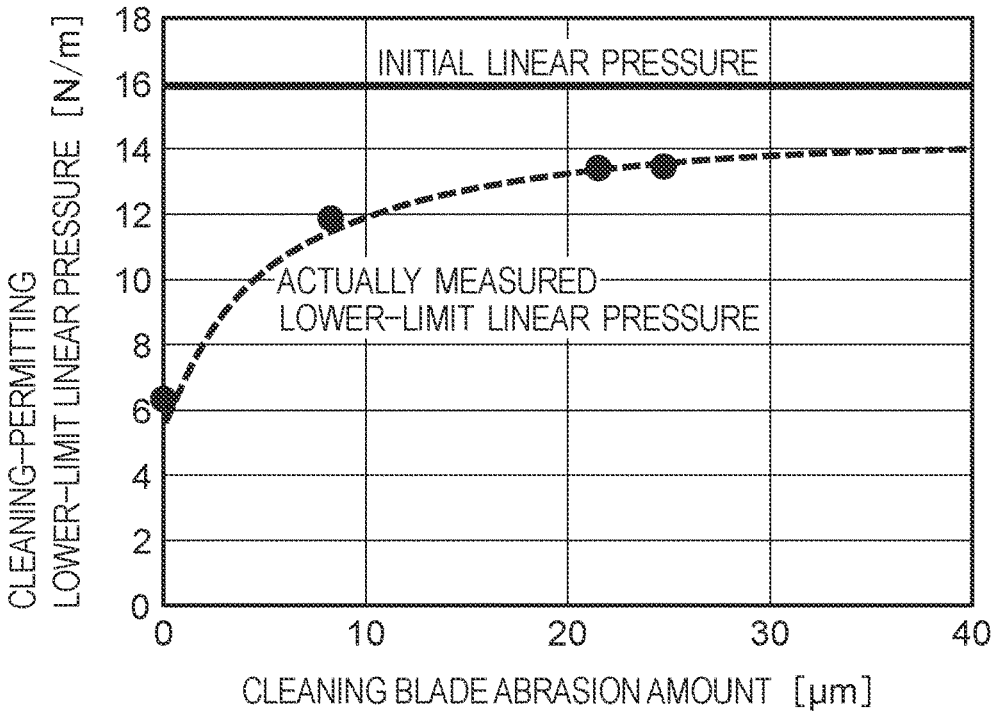
FIG. 5 is a graph showing a relationship between abrasion amount of the cleaning blade and cleaning-permitting lower-limit linear pressure.

FIG. 5 is a graph showing a relationship between abrasion amount of the cleaning blade 252 and cleaning-permitting lower-limit linear pressure. The relationship was measured in advance by conducting a durability test by experiment. An initial linear pressure of the cleaning blade 252 was measured in advance, and in this embodiment, the initial linear pressure was, for example, 16 N/m. It is clear that as the abrasion amount of the cleaning blade 252 increases, the cleaning-permitting lower-limit linear pressure measured by experiment (an actually measured lower-limit linear pressure) increases. Note that as a cumulative number of rotations of the photoconductive drum 21 increases, the abrasion amount of the cleaning blade 252 increases as a result of friction between the photoconductive drum 21 and the cleaning blade 252, and the like.

With a lapse of time from the beginning of the use of the photoconductive drum 21, an actual linear pressure of the cleaning blade 252 is gradually reduced from the initial linear pressure. The actual linear pressure of the cleaning blade 252 is reduced in accordance with use condition of the cleaning blade 252.

When the photoconductive drum 21 is rotating, the reduction in linear pressure becomes remarkable due to influence of the friction and the like. Even when the photoconductive drum 21 is not rotating, the cleaning blade 252 is constantly in linear contact with the surface of the photoconductive drum 21 with the predetermined pressure, and this can bethought to have an influence on the reduction in linear pressure. Furthermore, deformation and abrasion of the cleaning blade 252 formed of an elastic member is influenced also by external temperature outside the image forming apparatus 1. That is, main factors for the reduction in linear pressure of the cleaning blade 252 include, for example, a cumulative rotation time of the photoconductive drum 21 with which the cleaning blade 252 is in linear contact, a cumulative non-rotation time of the photoconductive drum 21, and the external temperature outside the image forming apparatus 1.

Thus, according to this embodiment, the control unit 8 of the image forming apparatus 1 calculates the actual linear pressure of the cleaning blade 252 by taking into account, with respect to the initial linear pressure of the cleaning blade 252 measured in advance, a linear pressure reduction based on the cumulative rotation time of the photoconductive drum 21, a linear pressure reduction based on the cumulative non-rotation time of the photoconductive drum 21, and a linear pressure reduction based on the external temperature detected by the temperature detection unit 12. When a linear pressure difference between the thus calculated actual linear pressure and the lower-limit linear pressure of the cleaning blade 252 calculated in advance from the abrasion amount of the cleaning blade 252 with respect to the cumulative number of rotations of the photoconductive drum 21 reaches a predetermined threshold value, the control unit 8 outputs, to the operation panel 11, information for urging replacement of the cleaning blade 252.

From FIG. 5, it can be estimated that, after a long-term use of the cleaning blade 252, when the abrasion amount of the cleaning blade 252 reaches approximately 40 μm, the cleaning-permitting lower-limit linear pressure measured by experiment will reach its limit at about 14 N/m. When the linear pressure difference between the calculated actual linear pressure of the cleaning blade 252 and the lower-limit linear pressure of the cleaning blade 252 calculated in advance reaches the predetermined threshold value, the control unit 8 outputs to the operation panel 11 the information for urging replacement of the cleaning blade 252.

According to the above configuration, it is possible to accurately estimate a linear pressure reduction commensurate with the actual use condition of the cleaning blade 252, and to quickly urge the user to replace the cleaning blade 252 when the linear pressure approaches the lower-limit linear pressure. This makes it possible to continue appropriate cleaning of the surface of the photoconductive drum 21.

Further, the control unit 8 calculates the linear pressure reduction based on the cumulative non-rotation time of the photoconductive drum 21 by applying a Williams-Landel-Ferry (WLF) equation. The WLF equation is a time-temperature conversion equation proposed by Williams, Landel, and Ferry regarding viscoelastic behavior of amorphous solid and liquid. The WLF equation can be expressed by equation (1) below, which indicates a preferable approximate value regarding deformation of a polymer material that is soft and highly deformable, such as a rubber material, for example.

[Equation 1]

$$\log_{10} t_s = \log_{10} t_0 + \frac{-C_2(T_1 - T_g)}{C_1 + T_1 - T_g} - \frac{-C_2(T_2 - T_g)}{C_1 + T_2 - T_g} \quad (1)$$

In equation (1), $t_s$ represents an estimated time, $t_0$ represents an unoperated time. $T_1$ represents an evaluation reference temperature (23° C.), $T_2$ represents an acceleration temperature, $T_g$ represents a material's glass transition temperature (tan δ), $C_1$ represents constant 1 (51.60), and $C_2$ represents constant 2 (17.44). The unoperated time to in equation (1) according to the WLF equation corresponds to the cumulative non-rotation time of the photoconductive drum 21 in this embodiment.

Figure 6:
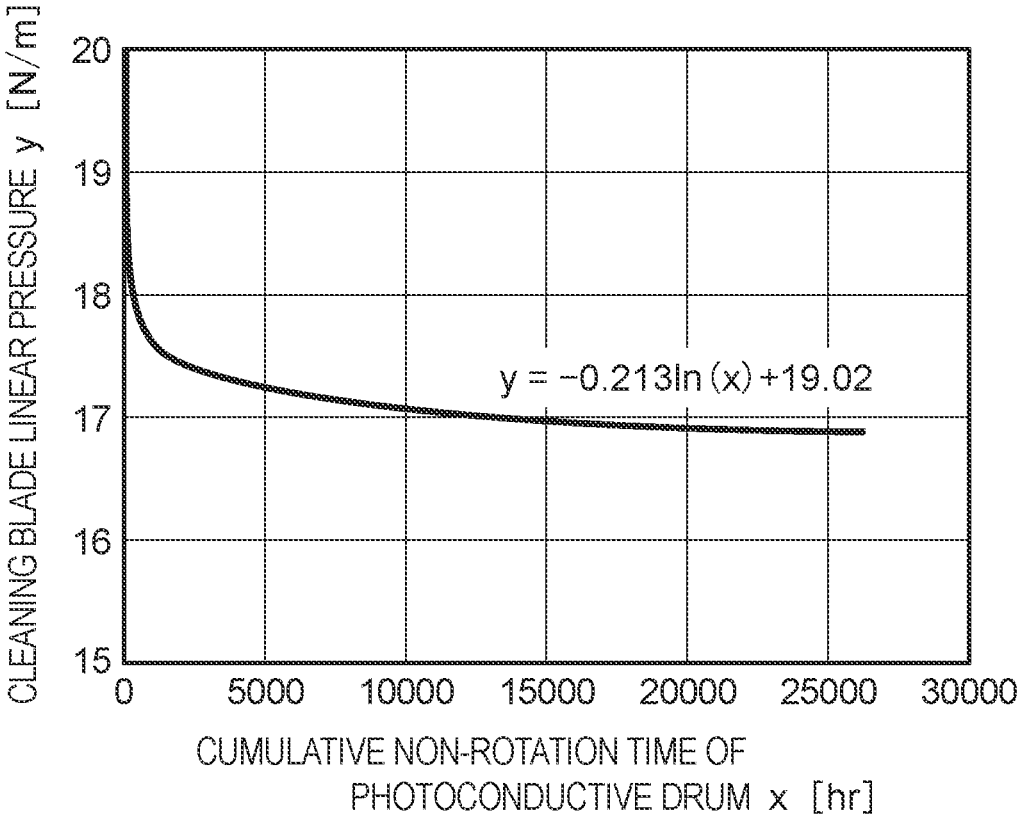
FIG. 6 is a graph showing a relationship between cumulative non-rotation time of a photoconductive drum and linear pressure of the cleaning blade.

According to the WLF equation described above and the linear pressure of the cleaning blade 252 measured in advance by experiment, the graph shown in FIG. 6 can be obtained. FIG. 6 is a graph showing a relationship between the cumulative non-rotation time of the photoconductive drum 21 and the linear pressure of the cleaning blade 252. The relationship between the cumulative non-rotation time of the photoconductive drum 21 and the linear pressure of the cleaning blade 252 can be expressed by equation (2) below, which is shown also in FIG. 6.

$$y = -0.213 \ln(x) + 19.02 \quad (2)$$

In equation (2), x represents the cumulative non-rotation time of the photoconductive drum 21, and y represents the linear pressure of the cleaning blade 252. By substituting the cumulative non-rotation time of the photoconductive drum 21 into equation (2) for x, the linear pressure of the cleaning blade 252 after a lapse of the cumulative non-rotation time, that is, the linear pressure reduction based on the cumulative non-rotation time of the photoconductive drum 21, can be calculated. It is possible to calculate a linear pressure reduction of the cleaning blade 252 that depends on time during which the photoconductive drum 21 has remained non-rotating.

The control unit 8, by applying the WLF equation, calculates the linear pressure reduction based on the external temperature outside the image forming apparatus 1 detected by the temperature detection unit 12. The acceleration temperature $T_2$ in equation (1) according to the WLF equation corresponds to the external temperature outside the image forming apparatus 1 in this embodiment.

Also, it is possible to calculate influence that the external temperature outside the image forming apparatus 1 has on the linear pressure reduction of the cleaning blade 252 by applying the external temperature as the acceleration temperature $T_2$ according to the WLF equation described above. That is, it is possible to calculate a linear pressure reduction of the cleaning blade 252 that depends on the temperature of the installation environment of image forming device 1.

In a case of a low coverage rate with respect to a sheet S, only a small amount of toner removed from the surface of the photoconductive drum 21 stays at a leading edge portion of the cleaning blade 252. As a result, friction increases between the photoconductive drum 21 and the cleaning blade 252.

Thus, the control unit 8 calculates the actual linear pressure of the cleaning blade 252 by taking into account a linear pressure reduction based on a cumulative number of sheets S having been subjected to image formation and a linear pressure reduction based on the coverage rate with respect to the sheets S. For example, in this embodiment, it is taken into account that in a case where, for every predetermined cumulative number of sheets S having been subjected to image formation, the coverage rate with respect to the sheets S is lower than a predetermined value, the linear pressure of the cleaning blade 252 is reduced by a greater amount than in a case where the coverage rate is higher than the predetermined value.

According to the above-described configuration, it is possible to accurately estimate a linear pressure reduction commensurate with the actual use condition of the cleaning blade 252.

The above-described embodiment is by no means meant to limit the scope of the present disclosure, and various modifications can be made within the scope not departing from the gist of the present disclosure.

For example, in the above embodiment, the image forming apparatus 1 is described as what is called a tandem-type image forming apparatus for color printing, which sequentially forms images of a plurality of colors one on top of another, but the image forming apparatus 1 is not limited to an image forming apparatus of such a type. The image forming apparatus may be a non-tandem type color image forming apparatus for color printing or a monochrome image forming apparatus.

What is claimed is:

1. An image forming apparatus, comprising:

an image carrier having a surface on which a toner image is formed;

a cleaning unit that includes a cleaning blade in linear contact with the surface of the image carrier, and that removes a residue remaining on the surface of the image carrier;

an output unit that outputs information regarding image formation;

a temperature detection unit that detects an external temperature;

a control unit that controls operation of the image carrier and the output unit, wherein, the control unit calculates an actual linear pressure of the cleaning blade by taking into account, with respect to an initial linear pressure of the cleaning blade measured in advance, a linear pressure reduction based on cumulative rotation time of the image carrier, a linear pressure reduction based on cumulative non-rotation time of the image carrier, and a linear pressure reduction based on the external temperature detected by the temperature detection unit; and the control unit outputs information for urging replacement of the cleaning blade to the output unit when a linear pressure difference between the actual linear pressure of the cleaning blade and a lower-limit linear pressure of the cleaning blade calculated in advance from an abrasion amount of the cleaning blade with respect to the cumulative number of rotations of the image carrier reaches a predetermined threshold value.

2. The image forming apparatus according to claim 1, wherein the control unit calculates the linear pressure reduction based on the cumulative non-rotation time of the image carrier by applying a Williams-Landel-Ferry equation.

3. The image forming apparatus according to claim 1, wherein the control unit calculates the linear pressure reduction based on the external temperature by applying a Williams-Landel-Ferry equation.

4. The image forming apparatus according to claim 1, wherein the control unit calculates the actual linear pressure of the cleaning blade by further taking into account the linear pressure reduction based on a cumulative number of recording media on each of which an image has been formed and a coverage rate with respect to the recording media.

* * * * *